United States Patent [19]

Conner et al.

[11] Patent Number: 4,984,684

[45] Date of Patent: Jan. 15, 1991

[54] AWARD-DESIGNATION APPARATUS FOR A GOLF CLUB BAG AND THE LIKE

[76] Inventors: John A. Conner; Dorothea H. Conner, both of 330 Clubhouse Ct., Coram, N.Y. 11727

[21] Appl. No.: 524,874

[22] Filed: May 18, 1990

[51] Int. Cl.[5] ..... A63B 55/00; A63B 57/00; A44C 3/00

[52] U.S. Cl. ..... 206/315.3; 40/1.5

[58] Field of Search ..... 40/1.5, 329; 206/457, 206/315.3, 315.4

[56] References Cited

U.S. PATENT DOCUMENTS

| | | | |
|---|---|---|---|
| 3,128,812 | 4/1964 | Scheurer | 206/315.4 |
| 3,193,956 | 7/1965 | Przybysiski | 40/1.5 |
| 3,462,862 | 8/1969 | Chase | 40/1.5 |
| 3,473,247 | 10/1969 | Favor et al. | 40/1.5 X |
| 4,130,956 | 12/1978 | Eddy et al. | 40/1.5 |
| 4,520,855 | 6/1985 | Dien | 206/315.4 |
| 4,625,862 | 12/1986 | Clayton | 206/315.3 |
| 4,776,043 | 10/1988 | Coleman | 40/329 |

*Primary Examiner*—William I. Price
*Attorney, Agent, or Firm*—Michael I. Kroll

[57] ABSTRACT

Award-designation apparatus is disclosed, which includes a first surface, which is, preferably, permanently affixed to a golf club bag. This first surface is to be manufactured so that a tack or a clip, etc., may be inserted into the surface, and readily removed therefrom if necessary. The preferred material for constructing such first surface of the present invention would be plastic or a plastic-like material. This first surface should preferably be manufactured so that it includes a relatively slight curvature. In this fashion, said first surface may be more readily affixed to an outer surface of a golf club bag, or other intended curved surface. In any event, said first surface, while able to be made from a relatively rigid material, should have at least some minimal degree of flexibility. The present invention further includes a second surface which is capable of acting as the award-designation means.

1 Claim, 1 Drawing Sheet

AWARD-DESIGNATION APPARATUS FOR A GOLF CLUB BAG AND THE LIKE

BACKGROUND OF THE INVENTION

1. Field of the Invention

The present invention relates generally to award-designating apparatus for a golf club bag or the like. More particularly, the present invention relates to an award-designation apparatus or system for articles, such as golf club bags whereby a person may readily employ such apparatus as a means for indicating to others the achievement of certain feats, such as achieving a hole-in-one, a championship title, etc.

It should further be recognized that the present invention may be further employed with articles unrelated to the sport of golf, or sports itself, and may instead be employed as a readily means of conveying various types of information to others which would be likely to be perceived by others with minimal effort on the part of the person wishing to convey such message.

2. Description of the Prior Art

Prior to the present invention, no means or apparatus was readily available for permitting, for example, a golfer, or other sportsperson from readily displaying his or her accomplishments or relevant achievements in the sport of golf, whether such accomplishments be related to a tournament championship or, for example, a hole-in-one.

Generally speaking, such skill accomplishments would only be known by means generally available to the public-at-large, such as write-ups in sports magazines and newspapers.

As will be explained in greater detail hereinafter, the present invention is directed toward overcoming the deficiencies previously existing in the prior art.

SUMMARY OF THE INVENTION

It is, therefore, an object of the present invention to provide an award-designation apparatus for a golf club bag and the like, which will fulfill the need lacking in the prior art.

It is a further object of the present invention to provide an award-designation apparatus for a golf club bag and the like, which may quickly and conveniently inform other persons of one's sporting accomplishments.

It is an additional object of the present invention to provide an award-designation apparatus for a golf club bag and the like, which may be manufactured and sold at an inexpensive cost.

It is, yet, a further object of the present invention to provide an award-designation apparatus for a golf club bag and the like which may be readily removed from said golf club bag when so necessary for maintaining, e.g., cleaning, said golf club bag.

It is, still, a further object of the present invention to provide an award-designation apparatus for a golf club bag and the like which is light weight so as not to unduly make more difficult the task of caddying during a golf game.

It is an additional object of the present invention to provide an award-designation apparatus for a golf club bag and the like which is durable so as not to break when bag is transported as, for example, by air.

The foregoing and related objects are accomplished by the award-designation apparatus of the present invention which includes a first surface, which is, preferably, permanently affixed to a golf club bag. This first surface is to be manufactured so that a tack or a clip, etc., may be inserted into the surface, and may be readily removed therefrom if so desired. The preferred material for constructing such first surface of the present invention would be plastic or a plastic-like material.

This first surface should preferably be manufactured so that it includes a relatively slight curvature and dimples, as in a golf ball. In this fashion, said first surface may be more readily affixed to an outer surface of a golf club bag or other intended, curved surface. In any event, said first surface, while able to be made from a relatively rigid material, should have at least some minimal degree of flexibility.

The present invention further includes a second surface which is capable of acting as the award-designation means. This second surface is preferably disk-shaped, though various other shapes are possible, with all such various other shapes being understood as being within the scope of the present invention.

Assuming that the second surface is substantially disk-shaped for purposes of this description of the invention, one side of such second surface includes designation means for informing others of one's sporting accomplishments, etc., while the other side of said disk-shaped second surface, said other side being the side opposite said first side, is provided with means for the attachment of said second surface to said first surface; said first surface having been previously affixed to an outer surface of said golf club bag.

The attachment of the second surface to said first surface is preferably a non-permanent attachment, i.e., utilizes attachments means which allow for the ready removal of said second surface from said first surface, when so desired. This will, for example, facilitate the eventual cleaning of the golf club bag, etc., as well as provide the owner, or other person, with the option of changing the designations for his or her golf bag on a periodic basis, if so desired.

It should, of course, be recognized that said second surface of the present invention may, optionally, be permanently affixed to said first surface of said invention, which, in turn, as previously described, is affixed to the outer surface of said golf club bag.

Means for attaching said second surface to said first surface of the invention include such non-permanent attachment means as the use of hook-and-loop fastening means, such as Velcro (registered trademark of the Velcro Corporation), clip means, such as a spring clip, and screw means.

Means for attaching said second surface to said first surface, which are of a more permanent nature, include tack means and, preferably, a pin which may employ a wing nut fastener. It should, however, be recognized that, in an absolute sense, essentially no attachment means need be absolutely permanent in nature.

Other means of attaching the second surface of the invention to the first surface are, of course, possible and would generally be known to the person of ordinary skill in the relevant technical art.

The designation means for placement upon the side of said second surface, which is opposite to the side of said attachment means for such surface, would include, for example, designations reciting that the player in possession of the golf club bag scored a "hole-in-one" or that the player won a particular tournament, etc.

It should further be recognized that the use of a plurality of so-called second surfaces, in combination with only a single first surface, said first surface being of an appropriate size, is possible and is preferred. This preferred embodiment of the present invention will be described in greater detail hereinafter in combination with the accompanying drawing figures.

Finally, in a preferred embodiment of the present invention, the preferred size of said second surface would be circular and would have the diameter of a golf ball. Such second surface may also, optionally, have a raised center portion so as to simulate a portion of a golf ball.

It of course, should be recognized that the present invention may be appropriately modified for use in combination with other than a golf club bag, but may be utilized, alternatively, for other sports as well as non-sporting activities and may, for example, be utilized in combination with any clothing article, such as a shirt, suit jacket or golf cap.

To the accomplishment of the above and related objects, the present invention may be embodied in the form illustrated in the accompanying drawing figures, attention being called to the fact, however, that the drawing figures are intended to be illustrative only, and that changes may be made in the specific construction illustrated and described within the scope of the appended claims.

BRIEF DESCRIPTION OF THE DRAWING FIGURES

In the drawing, wherein similar reference numerals denote similar features throughout the several views.

Figure 3:
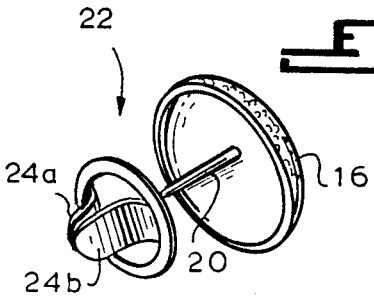
FIG. 3 is a perspective view illustrating the use of a pin and spring clip for attachment of said second surface of the present invention to said first surface.
Figure 3A:
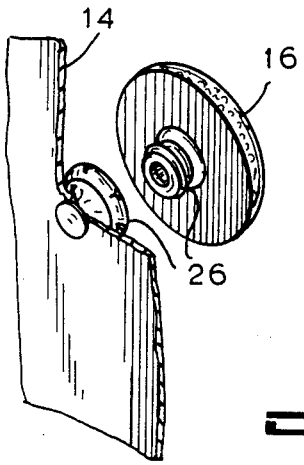
FIG. 3A is a perspective, partial view, as would be seen from an inner side of a golf club bag, illustrating the utilization of screw attachment means for attachment of said second surface of the present invention to said first surface.
Figure 3B:
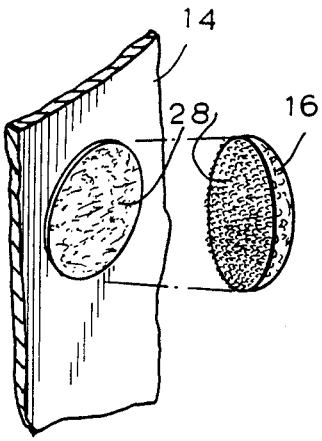
Figure 3C:
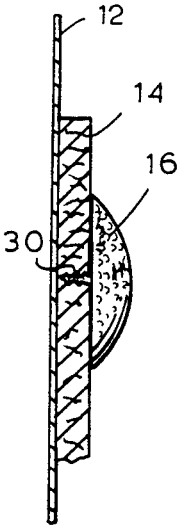

FIG. 3B is a perspective, partial view, as would be seen from an outer side of a golf club bag, illustrating the utilization of hook-and-loop attachment means for attachment of said second surface of the present invention to said first surface; and, FIG. 3C is a side, elevational view of the award-designation means of the present invention with said second surface of the invention affixed to said first surface via utilization of a tack.

DETAILED DESCRIPTION OF THE PREFERRED EMBODIMENTS

Figure 1:
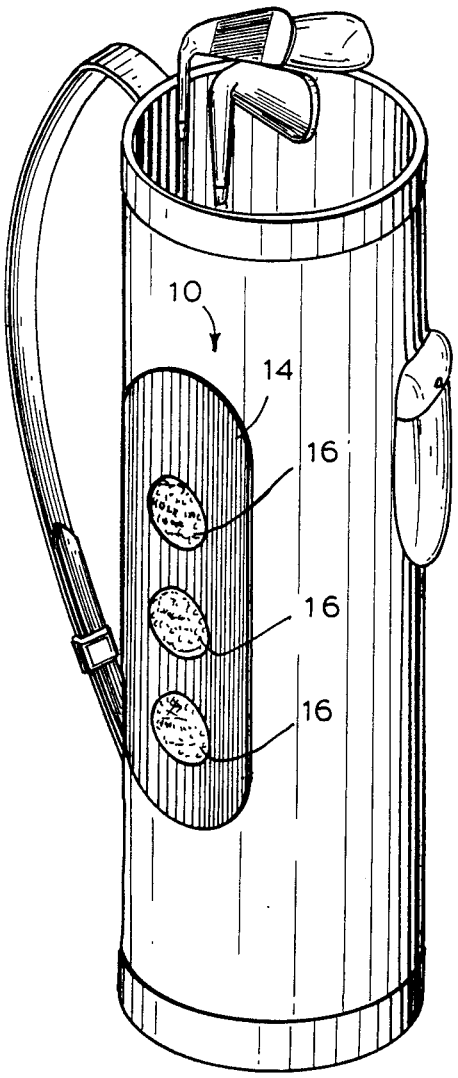
FIG. 1 is a perspective view of the award-designation apparatus of the present invention affixed to an outer surface of a gold bag.

Turning now, in detail, to an analysis of the accompanying drawing figures, FIG. 1 presents a perspective view of the award-designation apparatus 10 of the present invention affixed to an outer surface of a golf club bag 12.

Award-designation apparatus 10 is preferably provided with a first surface 14, which is affixed to an outer surface of golf club bag 12. First surface 14 is preferably made of material which would allow for the ready insertion of the attachment means of the present invention, for attaching the first surface 14 to a second surface, to be described in greater detail hereinafter. Accordingly, first surface 14 is preferably made of either plastic, or a plastic-like material.

Additionally, first surface 14 is preferably made with some slight curvature so that it may be more readily shaped and attached to the outer surface of golf club bag 12. First surface 14 is preferably permanently affixed to the outer surface of golf club bag 12 by, for example, adhesive means, such as via the use of an appropriate glue or cement for the attachment of such plastic material to the surface of a conventional golf club bag.

Affixed to the outer side of said first surface 14, i.e., the side opposite to the side which is attached to golf club bag 12, is a second surface 16. In a preferred embodiment of the present invention, as illustrated in FIG. 1, a plurality of said second surfaces 16 are provided for the simultaneous attachment to said first surface 14.

Figure 2:
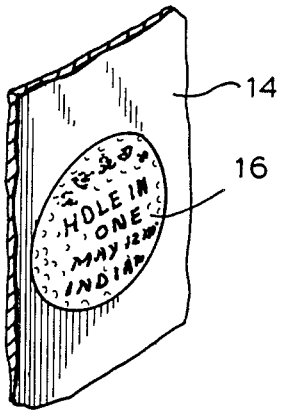
FIG. 2 is an enlarged perspective, partial view of the award-designation apparatus of the present invention with designation means designating the achievement of a hole-in-one.

Second surface 16 is, preferably, substantially disk-shaped, however various shapes, wholly distinct from that of a disk, may be employed. Additionally, second surface 16 is preferably circular with the diameter of a conventional golf ball, with the center portion thereof being raised so as to partially simulate a portion of a golf ball. This feature is best illustrated in FIGS. 2 and 3C.

The outer side of second surface 16, i.e., the side of second surface 16 not affixed to first surface 14 includes designation means for designating the sporting accomplishments, for example, of the person owning the golf club bag 12. As illustrated in FIG. 2, such designation means may read, for example, "HOLE-IN-ONE," with the date and place of such accomplishment. Preferably, there will be a plurality of such designations via the use of a plurality of second surfaces 16 upon said first surface 14.

FIGS. 3, 3A, 3B and 3C each illustrate various attachment means for both the permanent and removable attachment of second surface 16 to first surface 14.

More particularly, FIG. 3 illustrates a perspective view showing the use of a pin 20 and spring clip 22 for attachment of said second surface 16 of the present invention to said first surface 14. Spring clip 22 would be, preferably, permanently affixed to first surface 14. When pin 20 is inserted into spring clip 22, the resilient surfaces of spring clip 22, designated by the reference numerals **24*a* and 24*b***. The mode of attachment would generally be considered to be removable.

FIG. 3A provides a perspective, partial view, as would be seen from an inner side of a golf club bag 12, illustrating the utilization of screw attachment means 26 for attachment of said second surface 16 of the present invention to said first surface 14. In the preferred embodiment shown in FIG. 3A, it is contemplated that one complementary portion of screw attachment means 26 would be permanently affixed to said first surface 14, though the attachment of said second surface 16 to said first surface 14 would, overall, be removable in nature.

FIG. 3B is a perspective, partial view, as would be seen from an outer side of a golf club bag 12, illustrating the utilization of hook-and-loop attachment means 28 for attachment of said second surface 14 of the present invention 10 to said first surface 14. Such hook-and-loop attachment means 28 would generally be Velcro (registered trademark of the Velcro Corporation.) This material is made of complementary hook and loop portions with, preferably, the loop portion being permanently affixed to said first surface 14 and second hook portion being permanently affixed to a side of said second surface 16. It should be recognized that the complementary Velcro hook and loop portions may be, accordingly, reversed, i.e., with the complementary hook and loop portions being located on opposite surfaces. In a preferred embodiment of the present invention, the golf club bag is gold in color.

Finally, FIG. 3C is a side, elevational view of the award-designation means 10 of the present invention with said second surface 16 of the invention affixed to said first surface 14 via utilization of a tack 30. The tack 30 is preferably made as a permanent part of second surface 16 and may be readily inserted into first surface 14. The length of tack 30 should be less than the thickness of first surface 14, but should be long enough so that a firm hold of second surface 16 is made possible.

The foregoing attachment means, for attaching the second surface 16 to the first surface 14 are intended as being illustrative of such attachment means which may be used in combination with the present invention. Equivalent attachment means, it should be understood, are possible and are intended as being with the scope of the claimed invention.

LIST OF REFERENCE NUMERALS

10 award-designation apparatus
12 golf club bag
14 first surface of award-designation apparatus
16 second surface of award-designation apparatus
20 pin
22 spring clip
**24*a*** resilient surface of spring clip
**24*b*** resilient surface of spring clip
26 screw attachment means
28 hook-and-loop attachment means
30 tack It will be understood that each of the elements described above, or two or more together, may also find a useful application in other types of methods differing from the type described above.

While certain novel features of the present invention have been shown and described and are pointed out in the annexed claims, the present invention is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will be fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. Apparatus for the designation of an award on a golf bag, comprising:

a support comprising the outer surface of said bag;

a first surface having a first side and a second side, means permanently connecting said first side of said first surface to said support;

a second surface having a first side and a second side, said first side of said second surface being affixed to said second side of said first surface;

means for attaching said second surface to said first surface; and, designation means, said designation means being located on said second side of said second surface.

* * * * *